US006273725B1

(12) United States Patent
Bernstein et al.

(10) Patent No.: US 6,273,725 B1
(45) Date of Patent: Aug. 14, 2001

(54) PROCESS FOR TEACHING STUDENTS MULTIPLE CURRICULUM SUBJECTS THROUGH THE USE OF A THEATRICAL PRODUCTION

(75) Inventors: Patrik L. T. Bernstein, Torekov (SE); Jeannette A. Hammerstein, Tustin, CA (US)

(73) Assignee: Spotlight Enterprises, Inc., Long Beach, CA (US)

( * ) Notice: Subject to any disclaimer, the term of this patent is extended or adjusted under 35 U.S.C. 154(b) by 0 days.

(21) Appl. No.: 09/579,720

(22) Filed: May 26, 2000

Related U.S. Application Data

(63) Continuation-in-part of application No. 09/288,766, filed on Apr. 8, 1999, now Pat. No. 6,068,556, which is a continuation of application No. 08/845,324, filed on Apr. 25, 1997, now Pat. No. 6,004,216.

(51) Int. Cl.[7] ..... G09B 11/00

(52) U.S. Cl. ..... 434/81; 434/156; 434/188; 434/276; 434/154

(58) Field of Search ..... 434/81, 236, 237, 434/238, 428, 433, 322, 178, 247, 257, 154, 188; 472/75, 81; 446/82, 83, 84

(56) References Cited

U.S. PATENT DOCUMENTS

| | | | | |
|---|---|---|---|---|
| 1,451,108 | * | 4/1923 | Post | 434/178 X |
| 1,533,337 | * | 4/1925 | Purdy et al. | 472/75 |
| 1,828,535 | | 10/1931 | Kass . | |
| 2,511,452 | | 6/1950 | Anderson et al. . | |
| 2,828,757 | | 4/1958 | Thaxton, Jr. . | |
| 2,846,221 | | 8/1958 | Skinner . | |
| 3,596,701 | | 8/1971 | Cowan . | |
| 4,077,418 | | 3/1978 | Cohen . | |
| 4,764,142 | * | 8/1988 | Griffith et al. | 472/77 X |
| 5,096,214 | | 3/1992 | Walker et al. . | |
| 5,117,853 | | 6/1992 | Pruesner . | |
| 5,194,047 | | 3/1993 | Cabell . | |
| 5,352,149 | | 10/1994 | Melashenko et al. . | |
| 5,414,950 | | 5/1995 | Johnson, Sr. . | |
| 5,524,691 | | 6/1996 | Jines . | |

FOREIGN PATENT DOCUMENTS

| | | |
|---|---|---|
| 2240047A | 7/1991 | (GB) . |

* cited by examiner

*Primary Examiner*—Kien T. Nguyen
(74) *Attorney, Agent, or Firm*—Kelly Bauersfeld Lowry & Kelley, LLP

(57) ABSTRACT

A process is provided for teaching students multiple curriculum subjects through the use of a theatrical production. A play is first selected which has been created for student performance and adapted to the grade level of the students participating. Student lesson plans are provided, including worksheets in multiple curriculum subjects. These subjects include at least two of the following: language arts, math, science, health, and history. The students are assigned speaking or non-speaking roles in the play. Sound recordings are provided which pertain to the play. These sound recordings can include a soundtrack of the script of the play serving as an aid in teaching the students the roles of the play as well as sound effects and audio bites for use during the performance of the play. Templates are provided for creating backdrops and props for the play. A portable stage is erected within a classroom environment and used in performing the play. The portable stage is in the form of a mobile scenery arrangement which is easy to assemble and dismantle, and which can easily be transported, stored and used with uniform curtains and a uniform set of back-drops for the same performance.

20 Claims, 2 Drawing Sheets

PROCESS FOR TEACHING STUDENTS MULTIPLE CURRICULUM SUBJECTS THROUGH THE USE OF A THEATRICAL PRODUCTION

RELATED APPLICATIONS

This application is a continuation-in-part of U.S. patent application Ser. No. 09/288,766, filed Apr. 8, 1999 now U.S. Pat. No. 6,068,556, which is a continuation of U.S. patent application Ser. No. 08/845,324, filed Apr. 25, 1997, now U.S. Pat. No. 6,004,216.

BACKGROUND OF THE INVENTION

1. Technical Field

The present invention relates to stages, scenery, curtains, back-drops and decor for theatre productions, particularly for children's theatre productions of fairy-tales and the like, but also for use in a teaching and educational process.

2. Background Art

State-mandated learning standards, at all grade levels, are being established in core subject areas to set clear performance objectives for student achievement. Measuring student progress against these standards is becoming a priority for school districts around the nation.

Educators, researchers and students agree that the most powerful type of learning takes place when multiple senses, not only seeing or hearing but also saying and doing, are involved. A growing body of research is finding that the development of higher thinking order skills, such as critical and creative thinking, is measurably enhanced when lessons are delivered through the arts. Albert Einstein reported decades ago that playing the violin stimulated his ability to construct complex mathematical theories, bolstering the recent findings of research.

Previously, plays and fairy-tales were performed for children, the scenery, with curtains and back-drops, being made by hand for each occasion and each production. No ready-made stands were normally available for the scenery at nursery or comprehensive schools, etc., and it was difficult to dismantle the scenery and move it to another place. Simple theatre productions of children's plays should allow for three changes of back-drop, preferably taking place behind closed curtains. There should also be spaces hidden from the public, for assistants, actors with costume changes, prompters, etc. Such relatively simple scenery is time-consuming and resource-demanding to produce with conventional props and normal work methods.

OBJECTS OF THE INVENTION

A primary object of the present invention is to provide a process for teaching students multiple curriculum subjects through the use of a theatrical production and accompanying lesson plans.

Another object of the invention is to provide a scenery arrangement that is easy to assemble and dismantle and can easily be transported and stored and used with uniform curtains and a uniform set of back-drops for the same performance.

Yet another object is also to facilitate theatre productions and plays for children by means of the mobile scenery arrangement.

SUMMARY OF THE INVENTION

The present invention relates to a process for teaching students multiple curriculum subjects through the use of a theatrical production. This is accomplished by selecting a play created for student performance. The play should be adapted to the grade level of the students participating. Student lesson plans are provided, including worksheets in multiple curriculum subjects. These subjects include at least two of the following: language arts, math, science, health, and history. The worksheets are preferably completed before the performance of the play.

The students are assigned roles in the play. These roles may be speaking roles wherein the roles comprise parts of characters in the play. Alternatively, the roles are non-speaking and include stage crew, backdrop crew, sound crew, and/or props crew.

Sound recordings are provided which pertain to the play. These sound recording typically include a soundtrack of the script of the play which acts as an aid in teaching the students the roles of the play. The sound recordings can also include sound effects and audio bites for use during the performance of the play.

Templates are provided for creating backdrops and props for the play. A portable stage is erected within a classroom environment and used in performing the play. The mobile scenery arrangement, is assembled from connectable rod sections preferably having a length of 1 m. This basic concept allows scenery arrangements of varying sizes to be built in intervals of 1 m. The height is usually 2 m, the width 5 m and the depth 2 m.

The rod sections are also secured in corner members in order to construct a box-like tubular construction forming a substantially vertical left side and a substantially vertical right side, the left and right sides being joined to at least one upper front curtain rod and at least one upper rear back-drop rod, at least one of the ends of said rods being provided with a cord-tensioning device arranged to stretch a cord between the two ends of the rod, said cord being arranged to displaceably carry curtains or back-drop.

A stable tubular construction is thus obtained for curtains and back-drops to be attached on its curtain and back-drop rods. The taut cord at the upper front curtain rod is used to displaceably carry the curtain, while the taut cord of the upper rear back-drop rod is used to displaceably carry scenery back-drops.

A scenery arrangement according to the present invention is also suitable for packing into a suitable case in which each component has its place, for transport and storage.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The invention will now be described in more detail with reference to the accompanying drawings. In such drawings.

DETAILED DESCRIPTION OF THE PREFERRED EMBODIMENT

Figure 1:
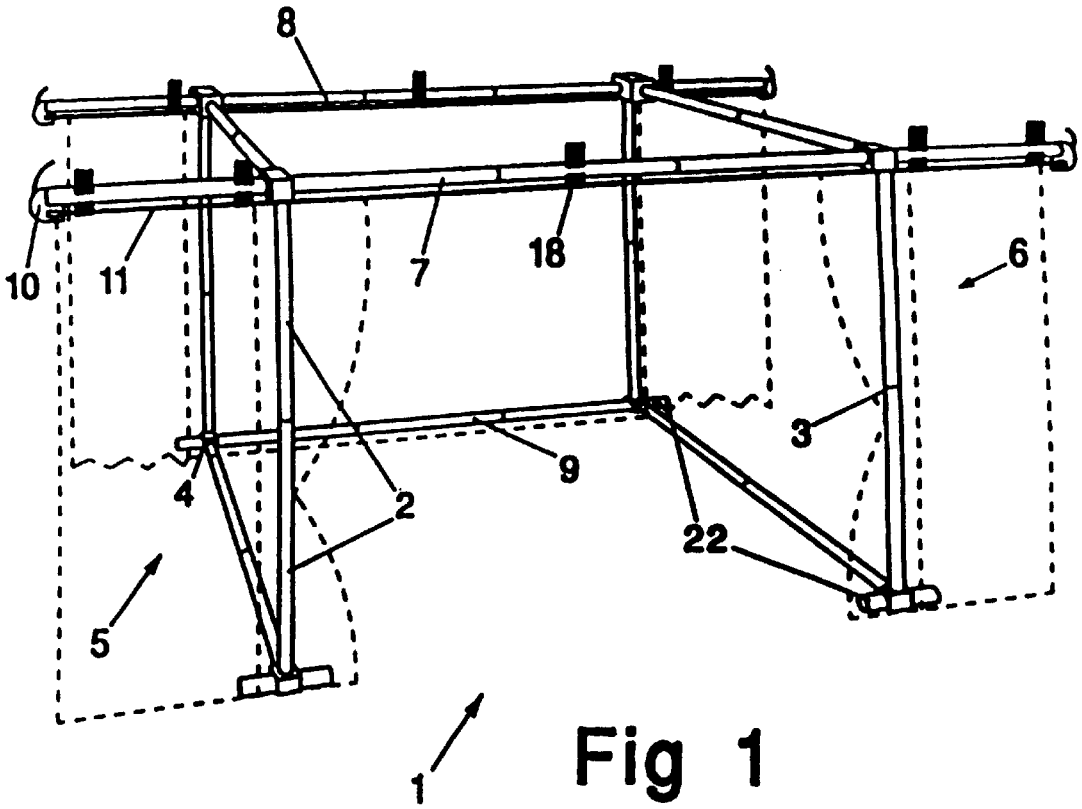
FIG. 1 shows schematically in perspective, a view of a scenery arrangement according to the present invention.

A mobile scenery arrangement according to the present invention is based on a tubular construction 1 comprising first rod sections 2, preferably aluminum rods with circular cross-section, joined by means of connectors 3 to desired lengths, which, with the aid of corner members 4, are fitted together to form a substantially vertical left side 5 and a substantially vertical right side 6, the left and right sides being joined at least one upper front curtain rod 7 and at least one upper rear back-drop 8 so that the tubular construction forms a box-like space. Both sides are also connected with a rear lower spacer 9.

Each corner member 4 is shaped to enable rod sections to be joined together to form a box-like construction. The corner members 4 are preferably identically shaped, each having four rod connections.

A cord-tensioning device 10 is also arranged to stretch a cord 11 between the two ends of the curtain rod 7 and/or back-drop rod 8. The cord 11 thus presses together the curtain or back-drop rod axially at the same time as providing a suspension arrangement suitable for displacement of curtains or back-drops. As can be seen in FIG. 1, both ends of the curtain and back-drop rods may be provided with cord-tensioning devices.

Figure 2:
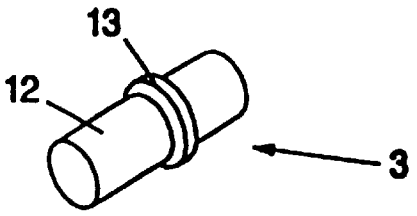
FIG. 2 shows a connector for rods according to the present invention.

The connector 3, see FIG. 2, consists of a relatively long connecting piece 12 which can be inserted with relatively tight fit into the ends of the rod sections in order to establish steadiness in the finished construction. The connecting piece 12 is provided centrally with a support flange 13 of the same exterior shape as that of the rod sections. The invention is not limited to the use of only rod sections of circular cross sections and these sections may also have rectangular, square or elliptical cross-section, for instance, in which case the other components in the construction shall be modified to suit the cross section of the rod.

As can be seen in FIG. 1, the curtain rod 7 extends outside the left side 5 and also outside the right side 6 so that, when the curtain is closed it also hides props, actors and assistants outside the actual stage area. When the curtain is fully open a certain amount of space on each side of the actual stage is still hidden.

The back-drop rod 8 also extends past both the left and the right sides so that a back-drop which, similar to a curtain, is suspended on a corresponding cord, can be displaced from the left side across the stage and out to the right. If three back-drops are used, maximally two back-drops are suspended on the cord at the rod section extending outside the left or right side. The cord at the back-drop rod and the extension of the back-drop rod outside the left and right sides thus contribute to facilitating change of back-drop.

Figure 3:
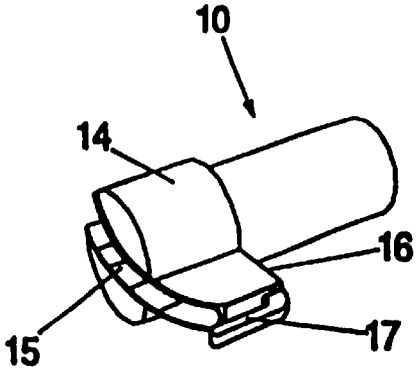
FIG. 3 shows a cord-tensioning device according to the present invention.

The cord-tensioning device 10, in the form of a plug insertable into the end of the rod, see FIG. 3, is provide with an attachment part 14 provided with a retaining slit 15 in conjunction with a cord guide 16 in the form of an aperture through the attachment part, parallel with the curtain/back-drop rod 7, 8. The cord 11 is thus guided through the cord guide 16 so that a suitable distance is obtained between cord and curtain/back-drop. The retaining slit 15 is designed to perform its function like a simple sheet clamp on a sailing boat so that the cord can be steplessly secured in the slit which has no movable parts. The attachment part 14 is provided with at least one curtain hook 17 on which the end of the curtain is secured to prevent it from being displaced during manipulation.

Figure 4:
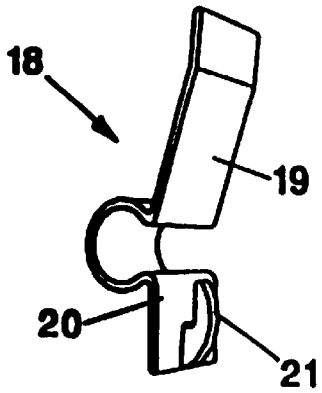
FIG. 4 shows a securing device according to the present invention.

The scenery arrangement is also provided with a number of securing devices 18, see FIG. 4, arranged to be secured by snapping them around a curtain rod 7 or back-drop rod 8. The securing device 18 is provided with an upwardly extending support means 19 in the form of a curved or bent tongue used as a holder for a pelmet. If the securing device is placed on the back-drop rod 8 the primary object of the support member is not to cover otherwise visible parts, but rather to provide hooks for various props or for hanging a permanent back-drop, such as a woodland background while the other back-drops can be exchanged to illustrate a glade, thick forest and a cottage in the forest. Another embodiment is to provide the embodiment shown FIG. in 1 with additionally at least on parallel back-drop rod in towards the front end of the scenery arrangement in order to carry additional back-drop covers. The securing device 18 is also provided with a downwardly extending hook means 20 with a hook 21. When the securing device 18 is used around the curtain rod 7 the hook 21 is used to hold up the curtain running along the cord 11. If the curtain is divided one securing device 18 is situated in the middle of the rod 7, one securing device 18 towards each end of the rod, close to each corner member, and one at each end of the curtain rod. Five securing devices are thus situated on the curtain rod. If the securing devices are placed on the back-drop rod 8, they may be turned so that the hook member 20 faces rearwards, enabling props to be hung up.

The tubular construction also comprises other rod sections 22, see FIG. 1, constituting support pieces for the construction and located at each of the four lower corner members 4 resting against the support surface, and possibly an additional rod section at each front lower corner member. These rod sections have a length of approximately 20 cm and can be connected to the corner members in the same way as the first rod sections 2.

A divided curtain has been indicated in broken lines in FIG. 1, to illustrate the function of the invention. A single curtain may also be used and is then operated all the way from the left side to the right side. Three back-drops with decor have also been indicate in broken lines in the Figure in order to show their function.

The components forming the construction can be varied infinitely within the scope of the invention.

Figure 5:
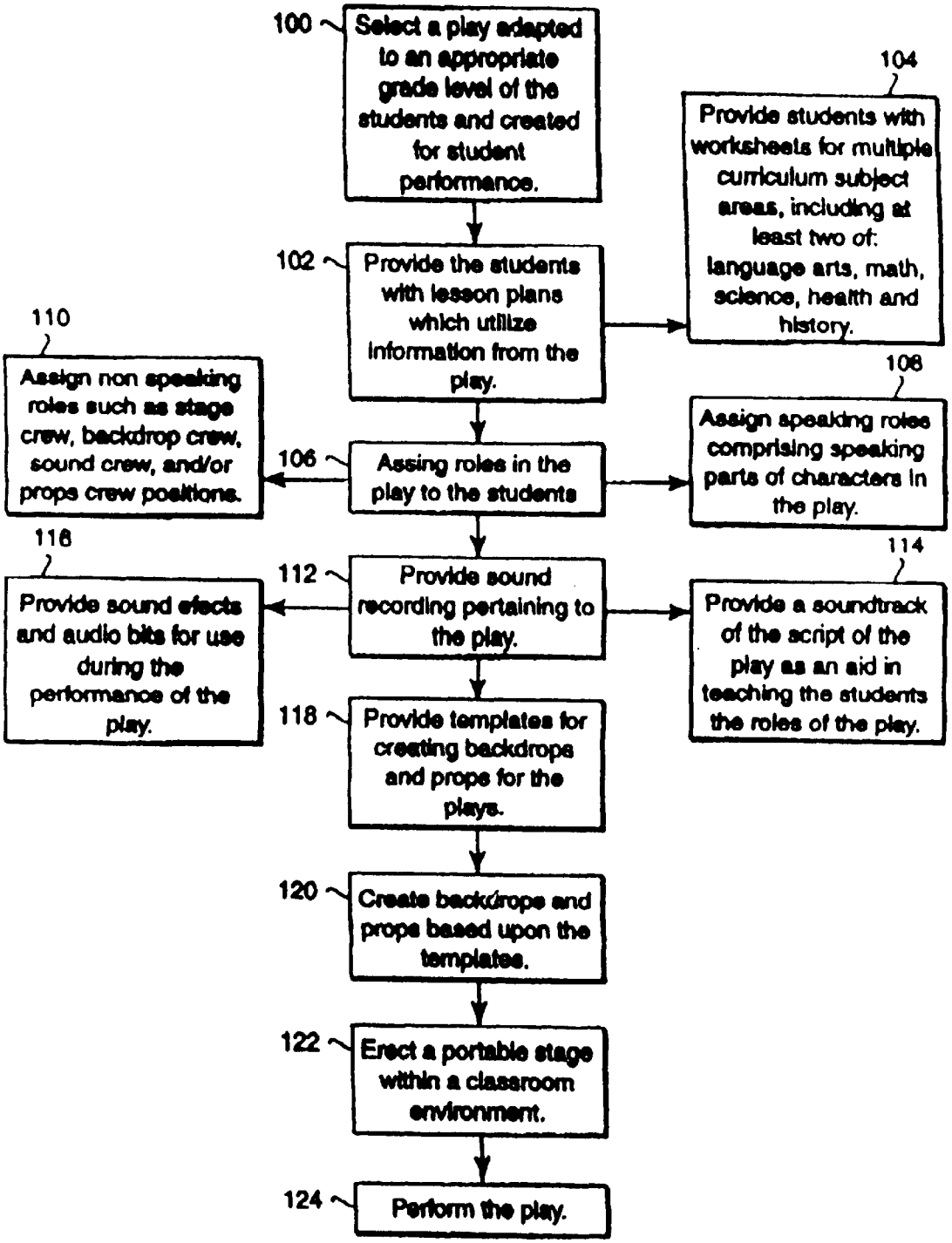
FIG. 5 is a flowchart illustrating the general steps in the process of teaching students according to the present invention.

The above-described mobile scenery arrangement is preferably used in a process for teaching students multiple curriculum subjects through use of a theatrical production. With reference to FIG. 5, a play which has been pre-written is selected (100). The play has typically been previously adapted for use in a particular grade or age level. The play can comprise well known fairy or folk tales, such as the Three Billy Goats Gruff for young students, completely fictitious and newly created plays, or plays based on historical events and adapted for use in the process of the invention, such as a pioneer westward trek or the Rosa Parks bus boycott events.

The teacher and students are provided lesson plans which utilize information from the play (102). More particularly, worksheets are provided for multiple curriculum subject areas, including language arts, math, science, health and history (104). There are always at least two of the curriculum subject areas addressed in any given play and supporting materials, and preferably there are four or more areas which are addressed in either the play itself or the lesson plans and worksheets.

For example, if the theatrical production is centered around the Rosa Parks story, the students will not only learn history and social studies implications and lessons from the play itself, but will be given additional worksheets. After learning the events of the story through the script of the play or even additional informational packets, a math worksheet may require students to calculate how long the bus boycott lasted. From this, how much money the bus company lost from Rosa Parks not riding the bus and paying the typical fare over this time period as well as an estimate of how much money the bus company lost based upon a given number of people not riding the bus during this time could be calculated. Creation or resolution of algebraic equations can also be included in such a worksheet. A science worksheet could address skin pigmentation and the various chemicals and substances within bodies which vary the degree of pigmentation. Experiments involving sun tanning could be performed to illustrate these concepts. Hypothesis and conclusions could be made as to why people from various areas of the earth are colored differently. Other plays would have worksheets in several curriculum subject areas, such as vocabulary from the play for language arts, which are tied into the theme and story of the play.

The students are assigned roles in the play (106). These roles can be speaking roles comprising speaking parts of characters or the narrator of the play (108). Alternatively, these roles can comprise non-speaking roles such as stage crew, backdrop crew, sound crew, props crew, and/or marketing crew. These students would be responsible for the creation of the stage, props, backdrops, tickets as well as the lighting and sound during the actual performance. Depending on the number of students participating, more than one role may be given to each student, or more than one student may be given a speaking role to act as an understudy or perform in a second performance.

Sound recordings pertaining to the play are provided (112). The sound recording typically includes a soundtrack of the script (114) read by others, such as actors, which aid the student in learning the story of the play as well as teaching the students having speaking roles their lines and inflections in voice and emotion possibly given at certain parts of the play. The sound recordings can also include sound effects and audio bites which are to be used during the actual performance and rehearsals of the play (116).

Templates are provided for creating backdrops and props for the play (118). These templates can be in the form of instructions which detail the construction of props or transparencies which can be used to actually create the backdrops by illuminating the backdrop and tracing the image. The backdrops are then colored by the students. The process encourages students to create their own props and add to the backdrop as suits the students. In this fashion, the students learn artistic skills. After the backdrops and props are created (120) a portable stage, preferably the stage arrangement described above, is erected within the classroom environment (122). The play can then be performed (124) in either a classroom setting or for the parents of the students.

As can be appreciated by the reader, learning using a theatrical production and accompanying materials as a vehicle allows the students to become participants in the process. Thus, the students not only read or hear the lesson material, but must apply the lessons from the plays and other materials. It is believed that such a hands-on learning process will stimulate students and make learning more fun than current teaching methods.

Although an embodiment has been described in some detail for purposes of illustration, various modifications may be made without departing from the scope and spirit of the invention. Accordingly, the invention is not to be limited, except as by the appended claims.

What is claimed is:

1. A process for teaching students multiple curriculum subjects through use of a theatrical production, comprising the steps of:

selecting a play created for student performance;

providing students lesson plans for multiple curriculum subject areas which utilize information from the play;

assigning roles in the play to the students;

erecting a portable stage within a classroom environment; and performing the play.

2. The method of claim 1, wherein the selecting step includes the step of selecting a play adapted to a grade level of the students.

3. The method of claim 1, wherein the providing lesson plans step includes the step of providing worksheets for student completion in multiple curriculum subjects before the completion of the performance of the play.

4. The method of claim 3, wherein the multiple curriculum subjects include at least two of the following: language arts, math, science, health and history.

5. The method of claim 1, wherein the assigning step includes the step of assigning speaking and non-speaking roles.

6. The method of claim 5, wherein the speaking roles comprise speaking parts of characters in the play.

7. The method of claim 5, wherein the non-speaking roles include stage crew, backdrop crew, sound crew, and/or props crew positions.

8. The method of claim 1, including the step of providing templates for creating backdrops and props for the play.

9. The method of claim 8, including the step of creating backdrops and props based upon the provided templates.

10. The method of claim 1, including the step of providing sound recordings pertaining to the play.

11. The method of claim 10, wherein the sound recordings include a soundtrack of a script of the play as an aid in teaching the students the roles of the play.

12. The method of claim 10, wherein the sound recordings include sound effects and audio bites for use during the performance of the play.

13. The method of claim 1, wherein the erecting step includes erecting a mobile scenery arrangement, comprising:

a substantially vertical left side having front and rear corner members;

a substantially vertical right side having front and rear corner members;

an upper front curtain rod adjoining the left and right sides by means of the respective front corner members; and an upper rear back-drop rod joining the left and right sides by means of the respective rear corner members;

wherein each rod has two ends and supports a cord therebetween, at least one of the ends of each of the rods being provided with a cord-tensioning device arranged to steplessly stretch the respective cord between the two ends of the rod.

14. A process for teaching students multiple curriculum subjects through use of a theatrical production, comprising the steps of:

selecting a play adapted to a grade level of the students and created for student performance;

providing students lesson plans including worksheets for multiple curriculum subject areas which utilize information from the play;

assigning speaking and non-speaking roles in the play to the students;

providing sound recordings pertaining to the play;

providing templates for creating backdrops and props for the play;

creating backdrops and props based upon the provided templates;

erecting a portable stage within a classroom environment; and performing the play.

15. The method of claim 14, wherein the multiple curriculum subjects include at least two of the following: language arts, math, science, health and history.

16. The method of claim 14, wherein the speaking roles comprise speaking parts of characters in the play and wherein the non-speaking roles include stage crew, backdrop crew, sound crew, and/or props crew positions.

17. The method of claim 14, wherein the sound recordings include a soundtrack of a script of the play as an aid in teaching the students the roles of the play.

18. The method of claim 14, wherein the sound recordings include sound effects and audio bites for use during the performance of the play.

19. The method of claim 14, wherein the erecting step includes erecting a mobile scenery arrangement, comprising:

a substantially vertical left side having front and rear corner members;

a substantially vertical right side having front and rear corner members;

an upper front curtain rod adjoining the left and right sides by means of the respective front corner members; and an upper rear back-drop rod joining the left and right sides by means of the respective rear corner members;

wherein each rod has two ends and supports a cord therebetween, at least one of the ends of each of the rods being provided with a cord-tensioning device arranged to steplessly stretch the respective cord between the two ends of the rod.

20. A process for teaching students multiple curriculum subjects through use of a theatrical production, comprising the steps of:

selecting a play adapted to a grade level of the students and created for student performance;

providing students lesson plans including worksheets for multiple curriculum subject areas, including at least two of the following: language arts, math, science, health and history, which utilize information from the play;

assigning speaking and non-speaking roles in the play to the students;

providing sound recordings pertaining to the play;

providing templates for creating backdrops and props for the play;

creating backdrops and props based upon the provided templates;

erecting a portable stage within a classroom environment; and performing the play;

wherein the speaking roles comprise speaking parts of characters in the play and wherein the non-speaking roles include stage crew, backdrop crew, sound crew, and/or props crew positions;

wherein the sound recordings include a soundtrack of a script of the play as an aid in teaching the students the roles of the play, sound effects and audio bites for use during the performance of the play; and wherein the erecting step includes erecting a mobile scenery arrangement, comprising:

a substantially vertical left side having front and rear corner members;

a substantially vertical right side having front and rear corner members;

an upper front curtain rod adjoining the left and right sides by means of the respective front corner members; and an upper rear back-drop rod joining the left and right sides by means of the respective rear corner members;

wherein each rod has two ends and supports a cord therebetween, at least one of the ends of each of the rods being provided with a cord-tensioning device arranged to steplessly stretch the respective cord between the two ends of the rod.

* * * * *